US007677945B2

(12) United States Patent
Skutsky et al.

(10) Patent No.: US 7,677,945 B2
(45) Date of Patent: Mar. 16, 2010

(54) METHOD OF FORMING AN EXTERNAL ELECTRODE FLUORESCENT LAMP, THICK FILM ELECTRODE COMPOSITIONS USED THEREIN, AND LAMPS AND LCD DEVICES FORMED THEREOF

(75) Inventors: Joel Skutsky, Durham, NC (US); Brian D. Veeder, Knightdale, NC (US); Andy Zao, Taoyuan (TW); Thomas Lin, Taoyuan (TW); Hsiu-Wei Wu, Hsinchu (TW); Tjong-Ren Chang, Hsinchu (TW); Shuang-Chang Yang, Hsinchu (TW); Wen-Chun Chiu, Hsinchu (TW); Jin-Yuh Lu, Taipei (TW)

(73) Assignees: E.I. du Pont de Nemours and Company, Wilmington, DE (US); Wellpower Optronics Co Ltd, Wilmington, DE (US)

( * ) Notice: Subject to any disclaimer, the term of this patent is extended or adjusted under 35 U.S.C. 154(b) by 419 days.

(21) Appl. No.: 11/805,919

(22) Filed: May 24, 2007

(65) Prior Publication Data

US 2008/0030654 A1 Feb. 7, 2008

Related U.S. Application Data

(60) Provisional application No. 60/802,912, filed on May 24, 2006.

(51) Int. Cl.
*H01J 9/00* (2006.01)
*H01J 1/62* (2006.01)

(52) U.S. Cl. ..... 445/26; 313/493

(58) Field of Classification Search ..... 445/24–26; 313/483–494

See application file for complete search history.

(56) References Cited

U.S. PATENT DOCUMENTS

| | | | | |
|---|---|---|---|---|
| 2,624,658 | A | 1/1953 | Greenlee | |
| 3,808,575 | A * | 4/1974 | Brandt et al. | 338/262 |
| 4,958,560 | A * | 9/1990 | Collins | 101/128.21 |
| 5,363,019 | A | 11/1994 | Itatani et al. | |
| 5,470,805 | A * | 11/1995 | Filmer | 501/55 |
| 5,889,366 | A * | 3/1999 | Yokokawa et al. | 313/607 |
| 6,191,539 | B1 * | 2/2001 | Green | 315/249 |
| 6,674,250 | B2 | 1/2004 | Cho et al. | |
| 6,914,391 | B2 | 7/2005 | Takedia et al. | |
| 2002/0195927 | A1 | 12/2002 | Groen et al. | |
| 2004/0135484 | A1 | 7/2004 | Lim | |
| 2006/0145618 | A1 | 7/2006 | Moon | |

FOREIGN PATENT DOCUMENTS

| | | |
|---|---|---|
| EP | 0 270 004 A2 | 6/1988 |
| EP | 1 111 656 A1 | 6/2001 |
| EP | 1 296 357 A2 | 3/2003 |

OTHER PUBLICATIONS

PCT International Search Report and Written Opinion for International Application No. PCT/US2007/012504 dated Jun. 19, 2008.

* cited by examiner

*Primary Examiner*—Nimeshkumar D. Patel
*Assistant Examiner*—Anne M Hines

(57) ABSTRACT

This invention relates to method(s) of fabricating electrodes of an external electrode fluorescence lamp (EEFL) for use in thin film transistor-liquid crystal display (TFT-LCD) applications. Also disclosed is a structure with electrodes for external electrode fluorescence lamps used in TFT-LCD backlight units.

9 Claims, 7 Drawing Sheets

METHOD OF FORMING AN EXTERNAL ELECTRODE FLUORESCENT LAMP, THICK FILM ELECTRODE COMPOSITIONS USED THEREIN, AND LAMPS AND LCD DEVICES FORMED THEREOF

FIELD OF THE INVENTION

The present invention relates to method(s) of fabricating the electrodes of an external electrode fluorescence lamp (EEFL) for use in thin film transistor-liquid crystal display (TFT-LCD) applications. This invention also provides a structure with electrodes for external electrode fluorescence lamps used in TFT-LCD backlight unit.

TECHNICAL BACKGROUND OF THE INVENTION

Liquid crystal display devices on a basic level comprise two pieces of polarized glass having a polarizing film side and a glass side. A special polymer that creates microscopic grooves (oriented in the same direction as the polarizing film) in the surface is rubbed on the non-polarizing film side of the glass. A coating of nematic liquid crystals is added to one of the filters. The grooves cause the first layer of molecules of the liquid crystals to align with the filter's orientation. The second piece of glass is added with the polarizing film at a right angle to the first piece. Each successive layer of liquid crystal molecules gradually twists until the uppermost layer is at a 90 degree angle to the bottom, thus matching the orientation of the second polarized glass filter.

As light strikes the first filter, it is polarized. If the final layer of liquid crystal molecules is matched up with the second polarized glass filter, then the light will pass through. The light which passes through is controlled through the use of electric charges to the liquid crystal molecules.

Active-matrix LCDs depend on thin film transistors (TFT). Basically, TFTs are tiny switching transistors and capacitors arranged in a particular matrix on the glass substrate. These TFTs control which areas receive a charge and therefore, the image seen by the viewer.

The light to the LCD device may be supplied through the use of a backlight unit. Two possible backlight unit types include cold cathode fluorescent lamps (CCFLs) and external electrode fluorescent lamps (EEFLs).

FIG. 4A illustrates a conventional external electrode in which metal capsules are bonded at the end of the glass tubes, and ferrodielectrics are applied to the inside of the metal capsules. This type of electrode is disclosed in U.S. Pat. No. 2,624,858 to Greenlee. However, the bonded portions of the electrodes can be easily damaged since the coefficient of the thermal expansion of the glass tubes is different from that of the metal capsule.

FIG. 4B illustrates another type of electrode, which is disclosed in U.S. Pat. No. 6,674,250 to Cho et al. The electrodes of Cho et al. are metal caps attached to the sealed glass tube by using conductive adhesives 16. In the same disclosure, the electrodes can also be conductive tapes 14 with adhesives wherein the tapes 14 are attached to the glass tubes 2, as shown in FIG. 4C.

FIG. 4D illustrates another type of electrode, which is disclosed in U.S. Pat. No. 6,914,391 to Takeda et al. The electrodes disclosed in Takeda et al. are aluminum foils 15, attached to the sealed glass tube 2 by using an electrically conductive silicone adhesive layer.

The use of adhesives, as in the prior art EEFLs mentioned above, has the disadvantage of creating weak bonds between the electrode and the glass tube of the EEFL device. The adhesives provide only mechanical bonding and the weak bonding of the electrodes may result in poor reliability performance. For example, gaps between the electrodes and the glass tubes may appear during thermal cycles due to the mismatching of thermal expansion coefficients between the metal caps (electrodes) and glass tubes. Gaps may also appear when the adhesives deteriorate in harsh environments. Gaps between the electrodes and the glass tubes can lead to EEFL failures because the high operating voltage of EEFL would not be uniformly applied to the glass tubes. Higher electrical resistance around the gaps leads to destructive damages to the glass tubes. Also, the higher stress around the gap can also intensify the separation and accelerate the failure of the device during the reliability testing.

The present invention is a novel method for forming the electrodes of an EEFL and for forming an LCD device. The invention relates to a fluorescent lamp with external electrodes and method(s) of forming such lamps and electrodes, wherein such methods and electrodes utilize thick film pastes, and backlight units formed from the methods described herein with particular utility in LCD applications.

SUMMARY OF THE INVENTION

The present invention provides a method of forming an external electrode fluorescent lamp comprising the steps of: providing a conductive layer thick film composition comprising electrically functional particles and organic medium; providing a cylindrical glass tube having a first end, a second end, and an inner peripheral wall wherein a fluorescent substance is provided along said inner peripheral wall and wherein a discharge gas is injected into said glass tube and wherein said glass tube is sealed on both said first end and said second end; applying the conductive layer thick film composition onto said first end and said second end of said glass tube; and firing said glass tube and conductive layer thick film composition to form an external electrode fluorescent lamp comprising an electrode on said first end and an electrode on said second end.

In one embodiment, the method of the present invention the applying step above is selected from dip coating, screen printing, roll coating, and spray coating. In a further embodiment, the method of further comprises a step of drying said conductive layer thick film composition prior to said firing step. In still a further embodiment, the method further comprises the steps of providing a protective layer composition and applying said protective layer composition either partially or completely over said conductive layer thick film composition on said first end and said second end after said firing step. In yet another embodiment, the conductive layer thick film composition of the present invention further comprises a glass frit.

In a further embodiment an external electrode fluorescent lamp is formed by the method(s) of the present invention detailed above and below. In another embodiment, a liquid crystal display device is formed which comprises the external electrode fluorescent lamp formed above.

DRAWINGS—REFERENCE NUMERALS

Figure 1A:
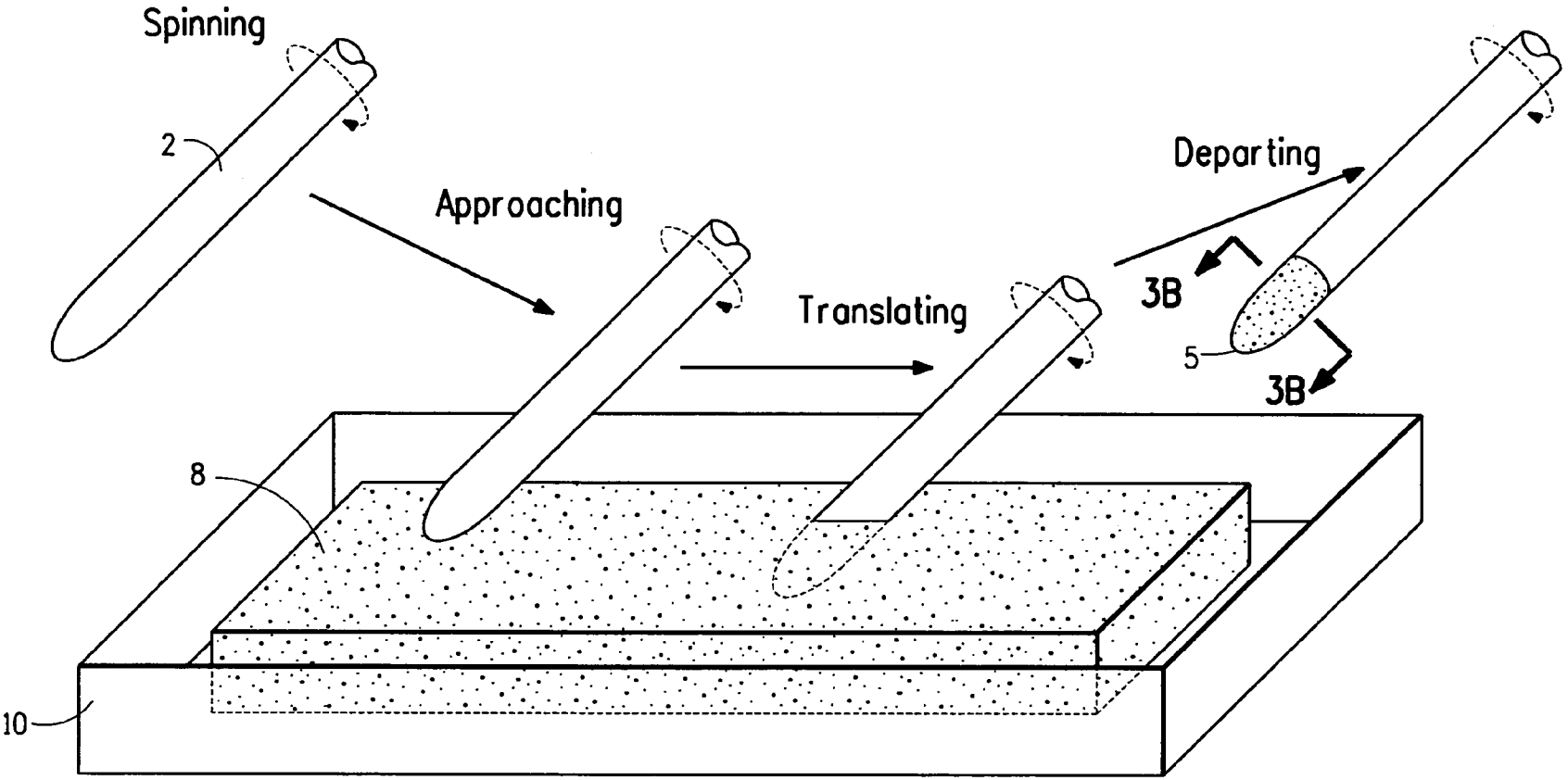
FIG. 1—an illustrative diagram showing different coating methods of the electrode pastes.

1—fluorescent lamp
2—glass tube
3—fluorescent substance
4—discharge gas
5—external electrodes
6—conductive layer
7—protective layer
8—electrode paste
8A—paste
8B—paste droplets
9—carrier of the glass tubes during firing process
10—tank
11—spray nozzle
12—feeding fixture for electric paste
13—metal capsule
14—conductive tape
15—conductive foil
16—conductive adhesive

DETAILED DESCRIPTION OF THE INVENTION

Disclosed herein are methods of forming external electrode fluorescent lamps. Referring to the drawings, an advantage of the invention is the excellent bonding strength of the attachment of external electrode 5 to the glass tubes 2 of the fluorescent lamps 1. This configuration provides improved reliability of the external electrodes. During the firing process, glass frit in the electrode paste 8 provides strong chemical and mechanical bonding of the conductive layer 6 (See FIG. 3(B)) to the glass tubes. Compared to the various examples in the art, the strong, uniform, and closely bonded structure of the electrode provides superior performance in reliability and electric characteristics.

Another advantage resulting from the good bonding of the electrodes is the electrical performance. Strong and uniform bonding of the electrodes provides very close contact of the electrodes to the glass tubes of the lamps, hence lower electric resistance and higher conversion efficiency of the power applied to the lamps to the power to excite the fluorescent substance inside the glass tubes. The AC power for operating EEFL is usually in a range of 40 kHz to 100 kHz and the bonding at the interface of electrodes and glass tubes would affect the device illumination efficiency more substantially in high electric frequency situations like that in EEFL. A further advantage of this invention is the ease of adaptation to mass production. The application processes in this invention, such as rolling, spraying, dipping etc., are typically easy processes in the industry. Low cost of equipment investment is required and EEFL devices with high performance reproducibility can be fabricated. Physical and performance uniformity of the electrodes is easier to achieve when the conductive materials are in the form of pastes, as mentioned in this invention, than in the form of tapes, metal caps, or foils, as mentioned in the prior arts. Thus, high quality EEFL devices can be fabricated in mass with easy adoption.

Figure 3A:
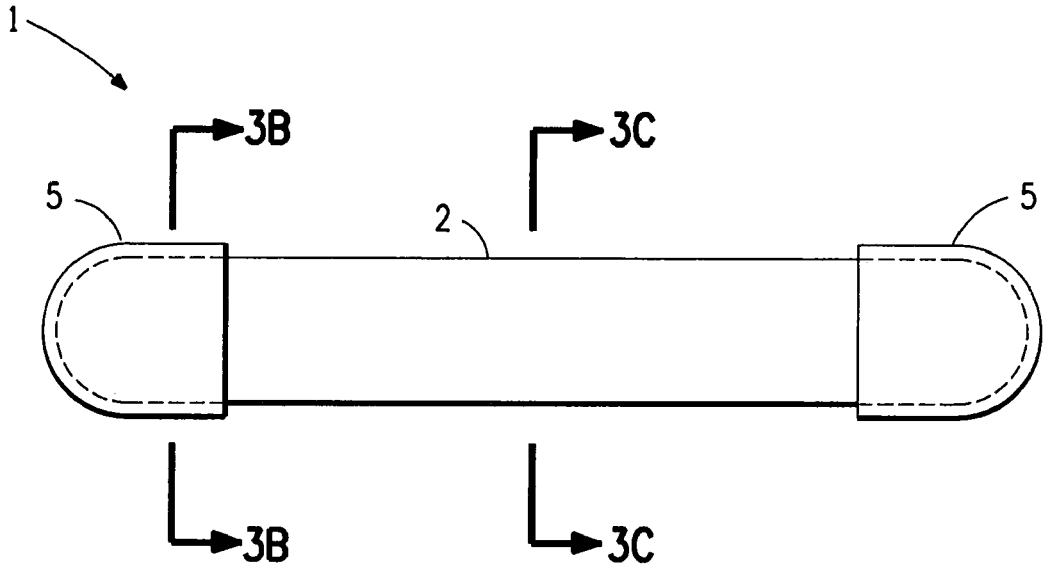
FIG. 3—a perspective view of the electrode structure of the external electrode fluorescent lamp.
Figure 3B:
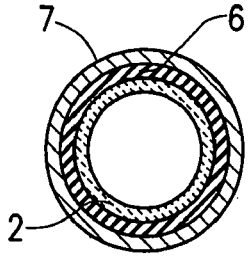
Figure 3C:
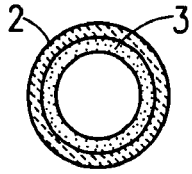
Figure 4A:
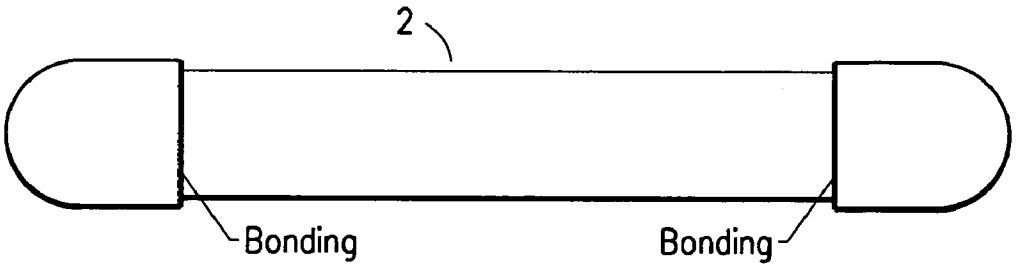
FIG. 4—an illustrative view of conventional external electrode fluorescent lamps.
Figure 4B:
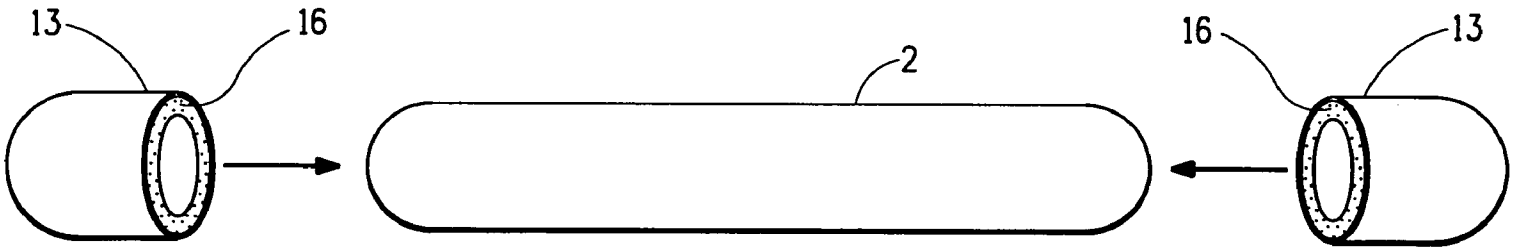
Figure 4C:
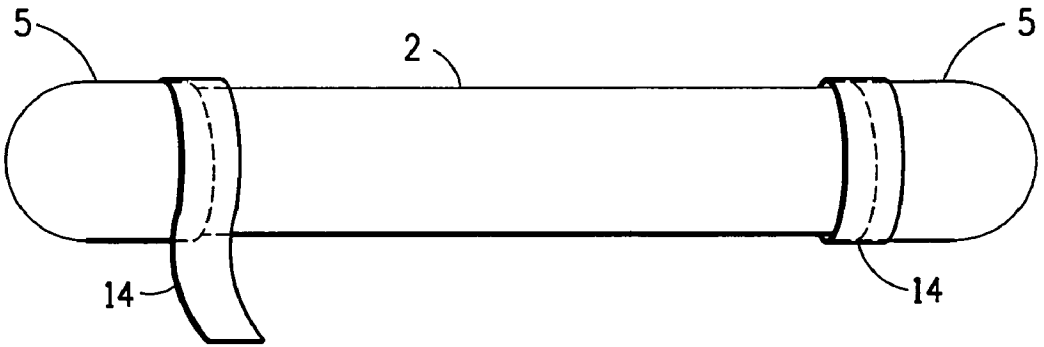
Figure 4D:
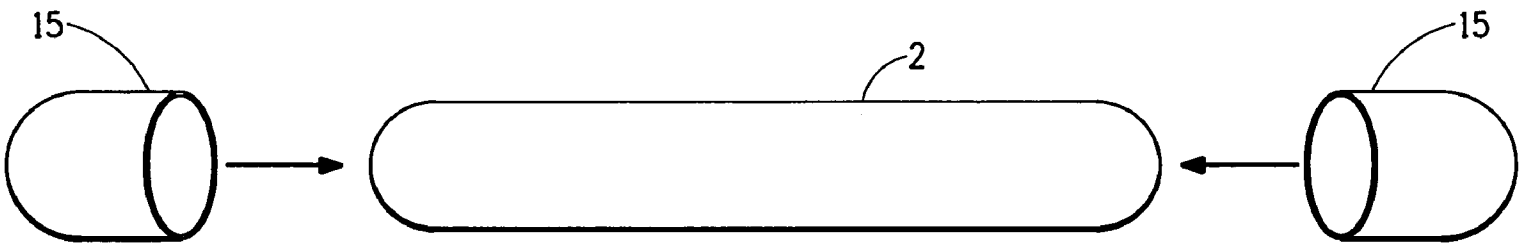

FIG. 3 shows a fluorescent lamp 1 according to one embodiment of the present invention. Referring to FIG. 3, the fluorescent lamp 1 includes a cylindrical glass tube 2. The fluorescent substance 3 is provided along the inner peripheral wall of the glass tube 2. After the fluorescent substance is applied inside the glass tube 2, a discharge gas 4 is used consisting of an inert gas, mercury (Hg), etc. mixed with one another, is injected into the glass tube 2, then both ends of the glass tube 2 are sealed.

Referring to FIG. 3, the external electrodes 5 of the fluorescent lamps 1 are respectively formed at the opposite ends of the sealed glass tube 2. The structure of the electrode 5 includes a conductive layer 6 and a protective layer 7 covering the conductive layer 6. The conductive layer 6 is a thick film paste which comprises metals, such as Al, Ag, Cu, etc. and binder materials. The metals chosen for use in this invention give the conductive layer 6 very low electrical resistance and the binder composition provides the conductive layer 6 strong adhesion to the glass tubes 2. Typically, the method of application of the thick film paste is screen printed or dip coated. However, other methods well known to those skilled in the art are possible. Applicable thick film paste compositions useful in the present invention are described in detail below.

I. Thick Film Paste Conductive Layer of Electrode

A. Electrically Functional Particles

In conductor applications, the functional phase is comprised of electrically functional conductor powder(s). The electrically functional powders in a given thick film composition may comprise a single type of powder, mixtures of powders, alloys or compounds of several elements. Electrically functional conductive powders that may be used in this invention include, but are not limited to gold, silver, nickel, aluminum, palladium, molybdenum, tungsten, tantalum, tin, indium, ruthenium, cobalt, tantalum, gallium, zinc, magnesium, lead, antimony, conductive carbon, platinum, copper, or mixtures thereof.

The metal particles may be coated or not coated with organic materials. In particular, the metal particles may be coated with a surfactant. In one embodiment, the surfactant is selected from stearic acid, palmitic acid, a salt of stearate, a salt of palmitate and mixtures thereof. The counter-ion can be, but is not limited to, hydrogen, ammonium, sodium, potassium and mixtures thereof.

A metal powder(s) of virtually any shape, including spherical particles and flakes (rods, cones, and plates) may be used in practicing the invention. In an embodiment, metal powders are gold, silver, palladium, platinum, copper and combinations thereof. In a further embodiment, the particles may be spherical.

In a further embodiment, the present invention relates to dispersions in an organic medium. The metal powder(s) may be nano-sized powders. Furthermore, the electrically functional particles may be coated with a surfactant. The surfactant may help to create desirable dispersion properties. Typical particle sizes of the electrically functional particles are less than approximately 10 microns. It is understood the particle size will vary dependent upon the application method and desired properties of the thick film composition. In one embodiment, an average particle size of 2.0-3.5 microns is used. In a further embodiment, the $D_{90}$ is approximately 9 microns. Additionally, in one embodiment, the surface area to weight ratio is in the range of 0.7-1.4 m2/g.

B. Organic Medium

The described inorganic components are typically mixed with an organic medium by mechanical mixing to form viscous compositions called "pastes", having suitable consistency and rheology for the applicable coating method, including but not limited to screen printing and dip coating. A wide variety of inert viscous materials can be used as organic medium. The organic medium must be one in which the inorganic components are dispersible with an adequate degree of stability. The rheological properties of the medium must be such that they lend good application properties to the composition, including: stable dispersion of solids, appropriate viscosity and thixotropy for screen printing, appropriate wettability of the substrate and the paste solids, a good drying rate, and good firing properties. The organic vehicle used in the thick film composition of the present invention is preferably a nonaqueous inert liquid. Use can be made of any of various organic vehicles, which may or may not contain thickeners, stabilizers and/or other common additives. The organic medium is typically a solution of polymer(s) in solvent(s). Additionally, a small amount of additives, such as surfactants, may be a part of the organic medium. The most frequently used polymer for this purpose is ethyl cellulose. Other examples of polymers include ethylhydroxyethyl cellulose, wood rosin, mixtures of ethyl cellulose and phenolic resins, varnish resins, and polymethacrylates of lower alcohols can also be used. The most widely used solvents found in thick film compositions are ester alcohols and terpenes such as alpha- or beta-terpineol or mixtures thereof with other solvents such as pine oil, kerosene, dibutylphthalate, butyl carbitol, butyl carbitol acetate, hexylene glycol and high boiling alcohols and alcohol esters. In addition, volatile liquids for promoting rapid hardening after application on the substrate can be included in the vehicle. Various combinations of these and other solvents are formulated to obtain the viscosity and volatility requirements desired.

The polymer present in the organic medium is in the range of 0.2 wt. % to 8.0 wt. % of the total composition. The thick film silver composition of the present invention may be adjusted to a predetermined, screen-printable viscosity with the organic medium.

The ratio of organic medium in the thick film composition to the inorganic components in the dispersion is dependent on the method of applying the paste and the kind of organic medium used, and it can vary. Usually, the dispersion will contain 40 wt %-90 wt % of inorganic components and 10 wt %-60 wt % of organic medium (vehicle) in order to obtain good wetting.

C. Optional Glass Frit

Typical glass frit compositions (glass compositions) of the present invention are listed in Table 1 below. The glass frit of the present invention is optional. It is important to note that the compositions listed in Table 1 are not limiting, as it is expected that one skilled in glass chemistry could make minor substitutions of additional ingredients and not substantially change the desired properties of the glass composition of this invention. For example, useful glass frit compositions may be modified to optimize abrasion resistance, solderability, plating, as well as other properties.

The glass compositions in weight percent total glass composition are shown in Table 1. Preferred glass compositions found in the examples comprise the following oxide constituents in the compositional range of: $SiO_2$ 4-8, $Al_2O_3$ 2-3, $B_2O_3$ 8-25, CaO 0-1, ZnO 10-40, $Bi_2O_3$ 30-70, $SnO_2$ 0-3 in weight percent total glass composition. The more preferred composition of glass being: $SiO_2$ 7, $Al_2O_3$ 2, $B_2O_3$ 8, CaO 1, ZnO 12, $Bi_2O_3$ 70 in weight percent total glass composition. Several embodiments of the present invention comprise a Pb-free glass composition. When glasses are used in the thick film composition of the present invention, this may lead to a more compatible thermal coefficient of expansion (TCE) match between the substrate and the composition upon processing. A particularly beneficial embodiment is one in which the thick film composition comprises a Pb-free glass.

TABLE 1

| Glass ID | Glass Composition(s) in Weight Percent Total Glass Composition | | | | | | |
|---|---|---|---|---|---|---|---|
| | Glass Component (wt % total glass composition) | | | | | | |
| No. | $SiO_2$ | $Al_2O_3$ | $B_2O_3$ | CaO | ZnO | $Bi_2O_3$ | $SnO_2$ |
| Glass I | 4.00 | 2.50 | 21.00 | | 40.00 | 30.00 | 2.50 |
| Glass II | 4.00 | 3.00 | 24.00 | | 31.00 | 35.00 | 3.00 |
| Glass III | 7.11 | 2.13 | 8.38 | 0.53 | 12.03 | 69.82 | |

Glass frits useful in the present invention include ASF1100 and ASF1100B, which are commercially available from Asahi Glass Company.

An average particle size of the glass frit (glass composition) of the present invention is in the range of 0.5 μm-5.0 μm in practical applications, while an average particle size in the range of 2.5 μm-3.5 μm is preferred. The softening point of the glass frit (Ts: second transition point of DTA) should be in the range of 300-600° C. The amount of glass frit in the total composition is in the range of 0.5 to 10 wt. % of the total composition. In one embodiment, the glass composition is present in the amount of 1 to 3 weight percent total composition. In a further embodiment, the glass composition in present in the range of 4 to 5 weight percent total composition.

The glasses described herein are produced by conventional glass making techniques. The glasses were prepared in 500-1000 gram quantities. Typically, the ingredients are weighed then mixed in the desired proportions and heated in a bottom-loading furnace to form a melt in platinum alloy crucibles. Heating is conducted to a peak temperature (1000-1200° C.) and for a time such that the melt becomes entirely liquid and homogeneous. The molten glass was quenched between counter rotating stainless steel rollers to form a 10-20 mil thick platelet of glass. The resulting glass platelet was then milled to form a powder with its 50% volume distribution set between 1-3 microns.

II. Optional Protective Layer of Electrode

The protective layer of the electrodes 7 is made of metals with low reactivity such as Sn in order to protect the conductive layer 6 from reacting with the elements of the environment, such as moisture and reactive gas. The protective layer is purely optional.

FIG. 1 shows different methods of applying conductive layer 6 of the electrodes onto the glass tube 2. The electrode materials, including metal powders and binders (as detailed above), are well mixed together to form electrode pastes 8. The conductive layer detail 6, shown in FIGS. 3B and 3C of the external electrode 5 is made of the electrode paste 8. Electrode pastes 8 of different viscosities can be applied onto the glass tubes 2 by different coating processes, such as rolling, spraying, dipping processes, and the like.

Referring to FIG. 1A, the example of rolling process of the glass tubes 2 can be done in three steps: one end of the glass tubes 2 approaching to, translating in, and departing from the electrode pastes 8. Throughout the rolling process, the glass tubes 2 are spinning by the axis penetrating both ends and the glass tubes 2 aligned in a small angle to the surface of the electrode pastes 8 in the tank.

Figure 1B:
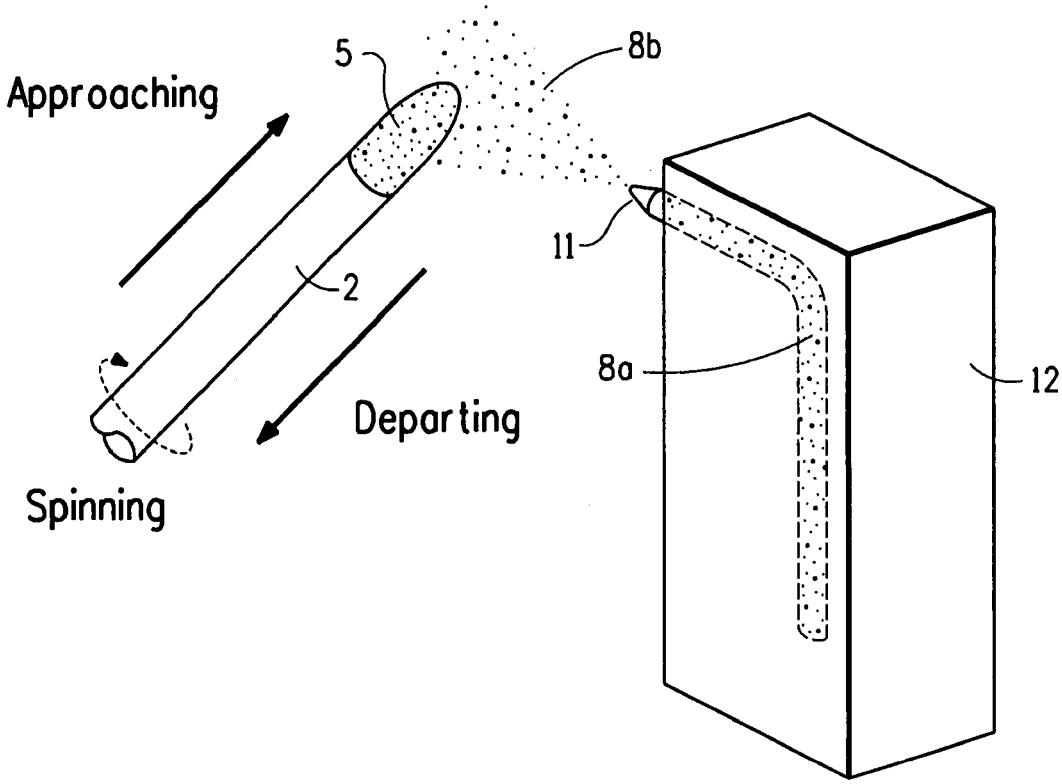

Referring to FIG. 1B, the example of spraying process is done by ejecting the electrode pastes 8 through a nozzle into the air to form droplets and the droplets of the electrode pastes 8 accumulate on the ends of the glass tubes 2. It's preferred that the glass tubes 2 spin during the process for better coating uniformity.

Figure 1C:
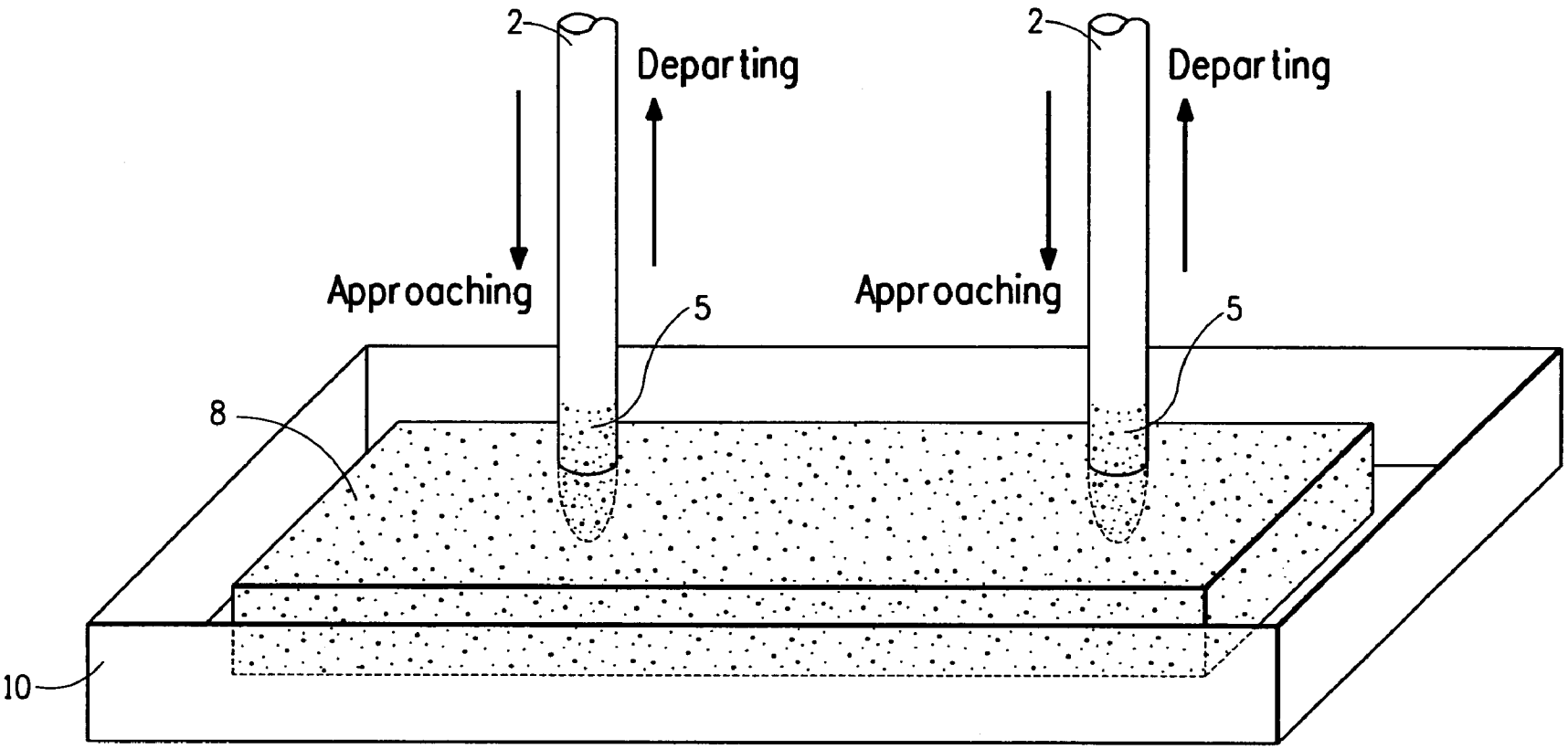

Referring to FIG. 1C, the example of dipping process was done by dipping the glass tubes 2 into the electrode pastes 8 and pulling away from the surface of the electrode pastes 8 in a tank. The alignment of the glass tubes 2 should not be limited to being perpendicular to the surface of the electrode pastes 8 and spinning of the glass tubes 2 can be adopted during the dipping process.

Figure 2:
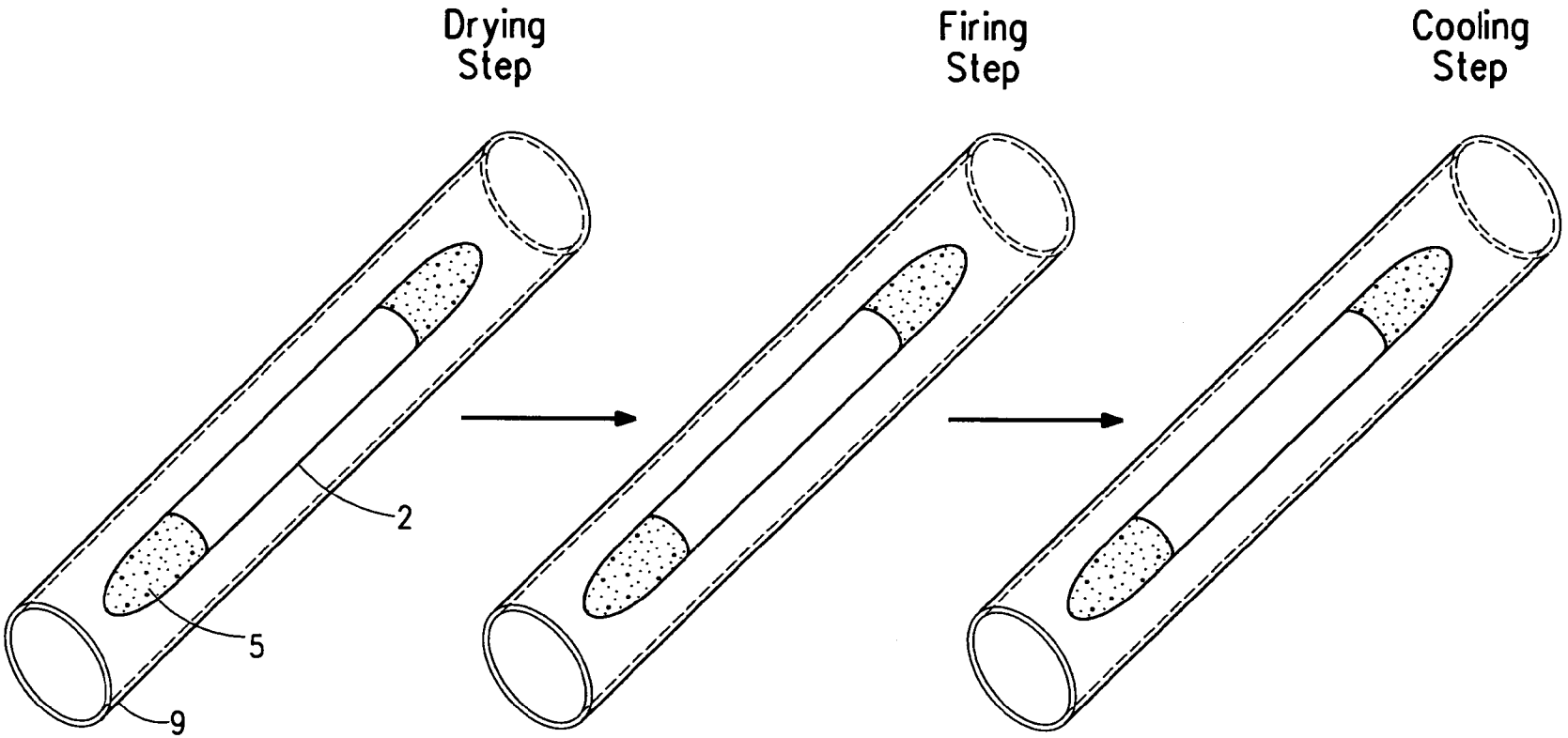
FIG. 2—an illustrative diagram of the manufacturing process after the electrode pastes are applied to the glass tubes as the electrodes of external electrode fluorescent lamp.

FIG. 2 shows the subsequent manufacturing process after the glass tubes 2 are coated with electrode paste 8. The subsequent process includes drying, firing, and cooling of the glass tubes 2. The process of drying, firing, and cooling can be done in the sense of batches or continuous process.

Referring to FIG. 2, drying process is defined and done by heating the glass tubes 2 and the conductive layer 6 to 50~180 degree C. for certain amount of time. The heating of the glass tubes 2 can be done in a drying oven by radiation, circulation of a heated atmosphere or both combined. The low boiling-point organic solvents in the electrode pastes 8 on the glass tubes 2 are driven away during drying process and the glass tubes 2 are then ready to go through the firing process because the conductive layer 6 is less susceptible to physical deformation after being dried.

Referring to FIG. 2, firing process is defined and done by heating the glass tubes 2 and conductive layers 6 to 300~600 degree C. The glass tubes can be heated by radiation, circulation of a heated atmosphere, or both combined in a firing furnace. During the firing step, heat-resistant carriers 9, e.g. quartz tubes, are used for uniform heating and mechanical support of the glass tubes 2. The composition of the heated atmosphere can be modified and controlled for different types of the electrode pastes and different targeted performance of the electrode pastes 8. In continuous firing process, the glass tubes 2 can be aligned perpendicular to the moving direction of the carrier 9 in order to have uniform heating of the glass tubes 2. The object of the firing process is to achieve low electrical resistance of the conductive layer 6 and high bonding strength of the conductive layer 6 to the glass tubes 2. During the firing process, all organic materials in the electrode pastes 8 are burned out. Typically, the firing step takes place in the temperature range of 300 to 600 degrees C. After firing, only metals and glass frit are left in the conductive layer 6 of the electrode.

After the firing process, the glass tubes 2 are slowly cooled down in the air. Referring to FIG. 2, cooling process provides a tempered decreasing temperature gradient for the glass tubes 2. Moderate cooling rate is necessary in order to slowly release the thermal stress at the interface between the glass tubes and the conductive layer 6 during the cooling process.

One embodiment of the present invention, glass frit is not included in the thick film paste conductive layer. The electrode paste in this alternative embodiment will comprise the function metals detailed above, such as Al, Cu, Ag, Au, and organic medium, such as solvents and resins. In one embodiment of this glass-free embodiment the firing temperature is in the range of 80 to 300 degrees C. In a further glass-free embodiment, the firing temperature is in the range of 300 to 600 degrees C. In one embodiment, the electrically functional particles are nano-sized particles. In some embodiments, the thick film composition comprises a polymer and is thus, a polymer thick film composition.

The advantages of this alternative glass-free embodiment include lower machinery cost, lower materials cost, and higher throughput of the process. The disadvantages of the alternative embodiment will be lower bonding strength and a slightly worse electrical performance. Both glass-containing and glass-free embodiments share the advantages of easy adoption to mass production.

The optional protective layer 7 of the external electrodes 5 are applied to the conductive layer 6 after the cooling process. Coating the conductive layer with less reactive metal layers, such as Sn, Ni, and Zn, can provide the protective layer 7 of the external electrode 5. Different coating processes, such as soldering, electrical plating, chemical plating etc., can be adopted for the protective layer 7.

Length of the external electrodes 5 needs to be optimized. Electrodes 5 length of EEFL 1 affects the electrical performance of the lamps significantly. Lamps with longer electrodes have larger contact area with the glass tubes 2 hence have lower electric resistance. For example, to obtain a typical tube current of 4 mA in the lamp having a reduced length lamp of 10 mm long, voltage as high as 1.7 times the voltage required for lamps with 20 mm long electrodes must be applied. The higher operation voltage of the lamps 1 with shorter electrodes 5 leads to issues such as ozone generation around the electrodes 5, the need for specially made insulating materials in the backlight module, and reaching inverter output voltage limit. Higher luminance of the lamp requires higher operation current. In order to operate the lamps in high electric current without high operation voltage, the solution of increasing the electrode length has been widely adopted. The drawback of this solution is that the actual illumination area of the lamp would be smaller with longer electrodes. Therefore, optimization of electrode length and lamp luminance should be considered.

EXAMPLES

Formation of Conductive Electrode for Testing

The following thick film paste composition was used to form a conductive electrode for reliability testing:

| Composition | Weight Percent Total |
|---|---|
| Material 1: | 12.1% |
| Material 2: | 2.0% |
| Material 3: | 1.35% |
| Glass Frit Composition (Bismuth-based): | 3.6% |
| Silver (Flake - 1-5 microns) | 74.4% |
| Xylene | 6.55% |

Detailed information on the composition components above are presented below.

Material 1
Pine Oil—60.8 weight percent
Damar Varnish—37.6 weight percent
Ethyl Cellulose—1.3 weight percent
Pyrogallic Acid—0.3 weight percent Material 2
Butyl Carbitol Acetate—75.4 weight percent
Dibutyl Phthalate—7.3 weight percent
Ethyl Cellulose—17.3 weight percent Material 3
MPA-60 Thixotrope—30 weight percent
Mineral Spirits—35 weight percent
Dibutyl Carbitol—35 weight percent Glass Frit Composition
Bismuth oxide—69.8 weight percent Zinc oxide—12.0 weight percent Boron oxide—8.4 weight percent Silicon dioxide—7.1 weight percent Aluminum oxide—2.1 weight percent Calcium oxide—0.6 weight percent The sum of thick film paste composition ingredients above is 100 weight % of the total composition.

Ingredients above were weighed and mixed (except for 1.7 weight percent Material 1 and the xylene). The composition was roll milled for 2 passes at a pressure of 0 psi followed by 2 passes each at the following pressures 100, 150, and 200 psi. Fineness of Grind (FOG) less than 12 um/6 um. The formulation was completed by adding 1.7% by weight of Material 1 and the xylene and mixed to obtain a composition with the following specifications:

Viscosity—4-6 Pascal·seconds, ½ RVT (RVT is a standard model of the viscosity meter), SC4-14/6r (SC4-14/6r is a testing setup, including cup and spindle, to be used with viscosity meter) at 10 revolutions per minute.

An external electrode fluorescent lamp was formed from the thick film composition above. First, a cylindrical glass tube (the lamp) was provided by Wellypower. The lamp specifications were as follows: (1) lamp length of 179 mm (for a 32 inch TFT-LCD BLU); (2) lamp diameter of 2.4 mm (inner) and 3 mm (outer); and (3) external electrode length of 25 mm. The conductive layer thick film prepared above was applied to the ends of the glass tube. The glass tube was fired at 500° C. for 65 minutes. Pb-free soldering was performed at 260° C.

Examples were performed (using the composition above) to determine lamp reliability using the novel composition(s) of the present invention. Reliability testing included (A) High Temperature (85° C.), high humidity (85% relative humidity) life test and (B) Burn-in life test. The following properties were tested at four different intervals (0, 150, 377, and 792 hours): (1) Start-up voltage (V measured at 65 kHz); (2) Luminance (operating current+7 mA·rms); (3) Chromaticity (X) (7 mA·rms) and (4) Chromaticity (Y) (7 mA·rms).

Tables 2 and 3 below detail the results of the reliability testing for High Temperature/High Humidity Life Test (A) above and Burn-in Life Test (B) above, respectively.

TABLE 2

Reliability - 85 Degrees C., 85% Relative Humidity

| Time (Hours) | Chromaticity (X) | Chromaticity (Y) | Start-Up Voltage (V) | Luminance |
|---|---|---|---|---|
| 0 | 0.266463 | 0.241538 | 1710.88 | 23718.8 |
| 150 | 0.270937 | 0.24735 | 1693.75 | 23847.5 |
| 377 | 0.271975 | 0.2494 | 1705.75 | 23416.3 |
| 792 | 0.2737 | 0.251487 | 1719.38 | 22986.3 |

TABLE 3

Reliability - Burn-in

| Time (Hours) | Chromaticity (X) | Chromaticity (Y) | Start-Up Voltage (V) | Luminance |
|---|---|---|---|---|
| 0 | 0.26665 | 0.241712 | 1658.13 | 24281.3 |
| 150 | 0.267571 | 0.244086 | 1665.88 | 23731.4 |
| 377 | 0.269029 | 0.246086 | 1677.13 | 23728.6 |
| 792 | 0.271271 | 0.249057 | 1680.57 | 23235.7 |

What is claimed is:

1. A method of forming an external electrode fluorescent lamp comprising the steps of:

providing a conductive layer thick film composition comprising electrically functional particles and organic medium;

providing a cylindrical glass tube having a first end, a second end, and an inner peripheral wall wherein a fluorescent substance is provided along said inner peripheral wall and wherein a discharge gas is injected into said glass tube and wherein said glass tube is sealed on both said first end and said second end;

applying the conductive layer thick film composition onto said first end and said second end of said glass tube; and firing said glass tube and conductive layer thick film composition to form an external electrode fluorescent lamp comprising an electrode on said first end and an electrode on said second end and wherein said conductive layer thick film composition further comprises a glass frit wherein said glass frit composition comprises: $SiO_2$ 4-8, $Al_2O_3$ 2-3, $B_2O_3$ 8-25, CaO 0-1, ZnO 10-40, $Bi_2O_3$ 30-70, $SnO_2$ 0-3, in weight percent total glass frit composition.

2. An external electrode fluorescent lamp formed by the method of claim 1.

3. A liquid crystal display device comprising the external electrode fluorescent lamp of claim 2.

4. The method of claim 1 wherein said firing step take place in the temperature range of 300 to 600 degrees C.

5. The method of claim 1 wherein said glass fit composition is a lead-free glass fit composition.

6. The method of claim 1 wherein the step of applying the conductive layer thick film composition is selected from the group consisting of dip coating, screen printing, roll coating and spray coating.

7. The method of claim 1 wherein there is a further step of drying said conductive layer thick film composition prior to said firing step.

8. The method of claim 1 further comprising the steps of providing a protective layer composition comprising metal and applying said protective layer composition either partially or completely over said conductive layer thick film composition on said first end and said second end after said firing step.

9. The method of claim 8 wherein said metal is Sn.

* * * * *

UNITED STATES PATENT AND TRADEMARK OFFICE

CERTIFICATE OF CORRECTION

PATENT NO. : 7,677,945 B2
APPLICATION NO. : 11/805919
DATED : March 16, 2010
INVENTOR(S) : Skutsky et al.

It is certified that error appears in the above-identified patent and that said Letters Patent is hereby corrected as shown below:

Title Page
item (73), Line 3: "Wellpower" should read -- Wellypower --

Signed and Sealed this

Eleventh Day of May, 2010

David J. Kappos

David J. Kappos
*Director of the United States Patent and Trademark Office*